US005126205A

United States Patent [19]

Chon et al.

[11] Patent Number: 5,126,205

[45] Date of Patent: Jun. 30, 1992

[54] POWDER OF PLASTIC AND TREATED MINERAL

[75] Inventors: Tuck Chon, Centereach; Burton A. Kushner, Old Bethpage; Anthony J. Retolico, Hauppage, all of N.Y.

[73] Assignee: The Perkin-Elmer Corporation, Norwalk, Conn.

[21] Appl. No.: 521,291

[22] Filed: May 9, 1990

[51] Int. Cl.[5] ..... B32B 5/16

[52] U.S. Cl. ..... 428/405; 428/463; 428/323

[58] Field of Search ..... 428/403, 402, 480, 45 G, 428/463, 405

[56] References Cited

U.S. PATENT DOCUMENTS

| | | | |
|---|---|---|---|
| 3,145,287 | 8/1964 | Siebein et al. . | |
| 3,455,510 | 7/1969 | Rotolico . | |
| 3,617,358 | 11/1971 | Dittrich . | |
| 3,655,425 | 4/1972 | Longo | 117/100 M |
| 3,723,165 | 3/1973 | Longo et al. . | |
| 3,784,405 | 1/1974 | Economy et al. . | |
| 4,076,883 | 2/1978 | Dittrich et al. . | |
| 4,388,373 | 6/1983 | Longo et al. . | |
| 4,416,421 | 11/1983 | Browning . | |
| 4,593,007 | 6/1986 | Novinski . | |

OTHER PUBLICATIONS

"KEN REACT (R) Zirconate Coupling Agent—NZ 39 Product Data Sheet" Kenrich Petrochemicals, Inc., Bayonne, N.J. Mar. 9, 1989.

"The Usage of Organometallic Reagents as Catalysts and Adhesion Promoters in Reinforced Composites" by G. Sugarman and S. J. Monte of Kenrich Petrochemicals, Inc.

*Primary Examiner*—Edith L. Buffalow

*Attorney, Agent, or Firm*—H. S. Ingham; E. T. Grimes

[57] ABSTRACT

A thermal spray powder is formed of granules of a silicon aluminum alloy each having bonded thereto discrete particles of a neoalkoxy zirconate type of organo-zirconate. A modified polyester powder may be blended with the mineral granules, in which case the polymeric granules also should have the zirconate bonded thereto. The powder is made by forming a slurry of alloy and zirconate starting powders with an organic binder, and drying the slurry to form the powder.

6 Claims, No Drawings

POWDER OF PLASTIC AND TREATED MINERAL

The present invention relates to a thermal spray powder, and particularly to such a powder characterized by improved bonding when thermal sprayed onto polymer substrates.

BACKGROUND OF THE INVENTION

Many mechanical parts in automobiles and airplanes have special mineral coatings such as metal or ceramic for special properties such as hardness, wear resistance, etc. Such coatings are provided on parts such as gears, pulleys, shafts, and the like, made of metal. However, the metal part itself is often just a carrier for the coating and could be replaced by lighter weight, often easier to fabricate, polymer or polymer composite, if it were possible to suitably coat the plastic.

A simple technique for coating surfaces with metal or ceramic is by thermal spraying, also known as flame spraying, employing either powder or wire as a spray material. When attempting to thermal spray onto plastic, however, special problems are encountered. Upon cooling, the sprayed metal contracts and may warp or distort the plastic. The coating sometimes fails to adhere uniformly. The plastic substrate may melt from the material being sprayed and lose its shape, or the plastic surface may burn or decompose. Further difficulties are encountered with bonding to composite substrates such as polyimide bonded carbon fiber.

As disclosed in U.S. Pat. No. 4,388,373 (Longo et al) it has been found that plastic substrates can be flame sprayed with a mineral powder which has been admixed with small amounts of nylon and epoxy polymers in powder form. The powder particles in finely subdivided form may be agglomerated with a binder or adhesive, mixed and dried, the agglomerates being composed of sub-articles of the individual components and being screened to recover particles of a particular size. The resulting agglomerates, or a simple powder mixture itself, can be flame sprayed in the conventional manner onto the substrate. The coating can range in thickness from about 25 μm to 5 mm or greater.

A composite powder of austenitic stainless steel, epoxy and nylon according to the above-described patent (assigned to a predecessor of the present assignee) has been quite successful for producing a thermal spray coating on plastic substrates, either for bonding another thermal spray coating or for use as is. However, spray technique is somewhat critical causing variation in results, and further improvement in bonding and cohesive strengths has been in demand. Also, for certain applications a different plastic constituent for the coating material is necessary or desired, for example a high temperature plastic.

U.S. Pat. No. 3,723,165 (Longo and Durmann) discloses thermal spray coating materials comprising a high temperature plastic and a metal. In particular a silicon aluminum powder blended with poly(paraoxybenzoyl)ester in accordance with Example 1 of that patent has been highly successful commercially as an abradable coating for turbine blade seals and the like in gas turbine engines. Again, however, the spraying is technique dependent and improved bonding and cohesiveness are desired.

Various binders have been used or suggested for forming composite thermal spray powders. For example, U.S. Pat. No. 3,617,358 (Dittrich) discloses spray drying to produce thermal spray powders of fine particles agglomerated with any of a variety of binders. Usually the binder is burned off, but may not be in certain cases of an inorganic binder. For example, U.S. Pat. No. 4,593,007 (Novinski) teaches silicon dioxide derived from ethyl silicate in the binder for producing an abradable and erosion resistant coating of an oxide and aluminum.

Coupling agents, typically silane coupling agents, have been used traditionally in the fiber glass industry to improve the integrity and moisture resistance of composites reinforced with glass fibers. Organofunctional silanes are hybrid organic-inorganic compounds that are used as coupling agents. There exists more than one theory as to how such agents couple polymers and minerals, one of which is the formation of covalent bonds. The covalent bonds are formed during the curing cycle of the resin during the manufacture of the composite.

Additive agents also have been used in the formation of composite thermal spray materials. For example the above-mentioned U.S. Pat. No. 3,617,358 discloses various additives to aid in deflocculating, wetting and the like for producing the organically bonded agglomerates. U.S. Pat. No. 4,076,883 teaches a thermal spray wire of mineral powder bonded with polymer, in which surface active resins are added for aiding in the bonding of particles in the polymer of the wire. In both of these patents the additives are disclosed for the purpose of aiding in the formation of the composite spray material with a polymer, there being no teaching of the additive having any effect on the ultimate thermal sprayed coating. In each case the organic binder ingredients including additives are generally intended to burn off in the thermal spray process.

Organo-zirconate coupling agents have become known recently for enhancement of adhesion between inorganic and organic components in resin matrix systems. Such a zirconate is described in a brochure "KEN-REACT® Zirconate Coupling Agent - NZ 39 Product Data Sheet", Kenrich Petrochemicals, Inc., Bayonne N.J., Mar. 9, 1989. Properties are given in an undated paper "The Usage of Organometallic Reagents as Catalysts and Adhesion Promoters in Reinforced Composites" by G. Sugerman and S. J. Monte of Kenrich Petrochemicals, Inc.

SUMMARY OF THE INVENTION

An object of the present invention is to provide a novel thermal spray powder having improved bonding strength and reduced technique dependence in bonding to plastic substrates, particularly to carbon fiber polymer composites.

The foregoing and other objects are achieved by a thermal spray powder comprising granules of a mineral each having an organo-zirconate bonded thereto. Preferably the mineral is a metal, particularly an alloy of aluminum with silicon. The organo-zirconate is advantageously in the form of discrete particles bonded to the granules of mineral with an organic binder. In a further aspect of the invention polymeric granules such a modified polyester may be blended with the mineral granules in which case the polymeric granules also should have the organo-zirconate bonded thereto.

Preferably the thermal spray powder is formed by a process comprising forming a slurry of a mineral powder and an organo-zirconate powder, optionally containing the polymeric particles, with an organic binder, and stir-drying the slurry to form the organo-zirconate coated powder.

DETAILED DESCRIPTION OF THE INVENTION

Broadly a thermal spray powder of the present invention is formed of granules of a mineral constituent. The mineral may be any conventional or desired inorganic material utilized for thermal spraying. Examples are listed extensively in the aforementioned U.S. Pat. Nos. 4,388,373 and 3,617,358. Preferably the mineral is a metal, most preferably a silicon alloy of aluminum which has a coefficient of thermal expansion similar to that of most plastics. The aluminum alloy has between about 8% and 15% silicon, e.g. 12% by weight. Generally the powder is in the conventional size range, vis. $-150+5$ microns, preferably $-88+45$ microns or alternatively $-45+5$ microns.

In a particular embodiment the powder further contains a polymeric powder blended with mineral. The polymeric constituent may be any conventional or desired thermal sprayable plastic such as polyester, epoxy, nylon, polyimide, polyester-ether-ketone or combinations thereof; or preferably a high temperature plastic such as disclosed in aforementioned U.S. Pat. No. 3,723,165. Examples of these high temperature plastics include the well-known polyimide plastics, polyamide-imide plastics, the polyester-imide plastics and the aromatic polyester plastics. Particularly suitable are high temperature aromatic polyester plastics of the type formed from phenyl acetate, as for example the poly(-para-oxybenzoly)ester or poly(para-oxybenzoylmethyl)ester, or a co-polyester of the type disclosed in U.S. Pat. No. 3,784,405 (Economy et al). The proportion of plastic to mineral should generally be in the range of 5% to 95% by volume, and preferably 5% to 25%.

According to the present invention the granules of the mineral constituent are treated such that each powder particle has a coating layer or discrete particles thereon comprising organo-zirconate. If there is a polymeric constituent this also should be so treated. The coating layer should have a thickness between about one half and two monolayers of zirconate, i.e. approximately one monolayer. The surface area of the powder needs to be determined to estimate the required concentration of the coating treatment. Surface area may be measured by the conventional B.E.T. analysis method.

A suitable organo-zirconate coupling agent is a neoalkoxy zirconate sold by Kendrich Petrochemicals, Inc. as NZ 39 and described in the aforementioned brochure. This agent has the chemical description zirconium IV 2,2(bis-2-propenolatomethyl) butanolato, tris 2-propenoato-O, and a chemical structure.

$$\begin{array}{l} CH_2{=}CH{-}CH_2O{-}CH_2 \qquad\qquad O \\ \qquad\qquad CH_3{-}CH_2{-}C{-}CH_2{-}O{-}Zr(OC{-}CH{=}CH_2)_3 \\ CH_2{=}CH{-}CH_2O{-}CH_2. \end{array}$$

This has at 95%+ solids and is soluble in organic solvents including isopropanol, xylene and toluene, and is insoluable in water.

In a suitable method for manufacturing a powder according to the present invention, the metal powder and organo-zirconate powder are placed in a steam heat pot. Polyvinyl pyrrolidone (PVP) solution in water is used as a binder and deionizer water are added and mixed in by stirring to obtain a homogeneous slurry. The steam is turned on to drive off the water during continuous mixing. Once the powder is dry and free flowing it is removed and screened to size.

A method for producing another form of powder involves dissolving the organo-zirconate in a solvent such as toluene. A slurry with metal powder is formed as above but with the solvent in place of water. The slurry is heated, stirred and dried as above to form a metal powder coated with a film of zirconate.

Generally the organo-zirconate should be at least one monolayer on the powder and up to about 1% by volume of the final powder. If organic powder is to be admixed, it preferably is blended into the metal powder in the pot before adding the zirconate. Alternatively, only the mineral powder is so treated, and the plastic powder is blended in afterward. The steam pot drying of the powder is done at sufficiently low temperature so as not to cure the plastic constituent or the zirconate with respect to it. Thus it has been discovered that the thermal spraying step which melts or at least surface heat softens the powder constituents effects the appropriate heat treatment to achieve excellent bonding and coating cohesion, without a high degree of spray technique dependence and apparently with retention of the zirconate to aid in the bonding. It is not yet understood how this occurs.

Coatings from about 25 microns to several millimeters in thickness may be produced by any of the powder thermal spray processes such as with a combustion spray gun of the type described in U.S. Pat. No. 3,455,510 (Rotolico) or a plasma spray gun of the type described in U.S. Pat. No. 3,145,287 (Seibein et al) or a high velocity oxygen-fuel gun such as described in U.S. Pat. No. 4,416,421 (Browning).

EXAMPLE 1

A silicon-aluminum alloy powder containing 12 weight percent silicon and a size of $-45+10$ microns is blended in a steam heated pot. An organo-zirconate sold as Capow NZ 39-H by Kenrich Petrochemicals, Inc., having a sized spread of about $-65+5$ microns and 0.45% by weight, is added to the aluminum-silicon with addition of polyvinyl pyrrolidone (PVP) solution and deionized water to obtain a homogeneous slurry. During continuous blending the steam is turned on to drive off the solvent and dry the powder. Once the powder is free flowing it is removed and screened to $-75+45$ microns.

The blend is sprayed with a high velocity oxygen-fuel spray gun specifically a Metco Type DJ TM gun sold by The Perkin-Elmer Corporation, Westbury, N.Y., using a #3 insert, #3 injector, "A" shell, #2 siphon plug and #2 air cap. Oxygen is 10.5 kg/cm$^2$ (150 psig) and 212 l/min (450 scfh), propylene gas at 7.0 kg/cm$^2$ (100 psig) and 47 l/min (100 scfh), and air at 5.3 kg/cm$^2$ (75 psig) and 290 l/min (615 scfh). A high pressure powder feeder sold as a Metco Type DJP powder feeder by Perkin-Elmer is used to feed the powder blend at 1.6 kg/hr in a nitrogen carrier at 8.8 kg/cm$^2$ (125 psig) and 7 l/min (15 scfh). Spray distance is 20 cm.

Coatings 2.54 mm thickness were produced with the coated powder on a polyimide PMR-15/carbon fiber composite sold by Hysol Composites, Cleveland Ohio and prepared by light grit blasting. The coatings had a bond strength of 1.4 kg/cm$^2$ (1000 psi) compared with 0.28 kg/cm$^2$ (200 psi) for a coating of Example 1 of the aforementioned U.S. Pat. No. 4,388,373 (Metco 625 powder) on a similar substrate.

A 100 micron thick coating of the present example had a surface roughness of at least 12 microns (500 microinches) aa, so as to be ideal for subsequent application of a mineral overcoat. After deposition of the overcoat, the bond to the plastic substrate was so tenacious that in test fractures metal particles adhered to the plastic substrate, pointing up the strong adhesion of the undercoat-overcoat combination to the plastic. Overcoating with thermal sprayed coatings of nickel chromium alloy gave strongly adherent overcoats.

Photomicrographs clearly show the reason for the difference in the bond strengths. Cross sections at a magnification of 400X of coatings on a laminate using untreated powder in the blend reveal extensive microcracking between the coating and the substrate. Coatings produced with powder treated according the present example show no such cracking and excellent adhesive to the substrate.

EXAMPLE 2

The silicon aluminum alloy powder of Example 1 is blended with 40% by weight (56% by volume) of a high temperature aromatic polyester plastic, poly(para-oxybenzoyl)ester, sold under the trade name of EKONOL by the Carborundum Company, Sanford, N.Y., having a size of $-88+44$, microns. The blend is treated with the organo-zirconate in the same manner and similarly thermal sprayed. Excellent and well bonded coatings are obtained. The coatings are particularly useful as abradable clearance control coatings having improved abrasion resistance over untreated material.

EXAMPLE 3

Example 1 is repeated with a Metco Type 9MB plasma spray gun using a Metco Type 4MP powder feeder, using the following parameters. 733 nozzle, No. 2 feed port, argon plasma gas at 100 psi and 100 l/min (212 scfh) flow, hydrogen secondary gas at 3.5 kg/cm$^2$ (50 psi) and 9 l/min (19 scfh) flow, 500 amperes and 70 volts, cooling air jets at 5.25 kg/cm$^2$ (75 psi), 1.5 kg/hr powder feed rate in argon carrier gas, and 9 cm spray distance. Bond strength is again very good.

EXAMPLE 4

The coating of Example 1 was used as a bond coat on the carbon fiber composite. A nickel-chromium-iron-molybdenum (Inconel 718) powder was used as a top coat. The latter powder was sprayed with the same system used for Example 1 with the same gun but different parameters. Oxygen is 10.5 kg/cm$^2$ (150 psig) and 353 l/min (750 scfh) propylene gas at 7.0 kg/cm$^2$ (100 psig) and 62 l/min (132 SCFH), and air at 5.3 kg/cm$^2$ (75 psig) and 349 l/min (742 SCFH). Spray distance is 25 cm and powder feed rate at 3.6 kg/hr in a nitrogen carrier at 8.8 kg/cm$^2$ (125 psig) and 7 l/min (15 SCFH). Coatings 5.08 mm thickness were produced over the aluminum-silicon/zirconate coated PMR-15 carbon-fiber composite. Bonding was very good, with a strength of 1.4 kg/cm$^2$ (1000 psi).

While the invention has been described above in detail with reference to specific embodiments, various changes and modifications which fall within the spirit of the invention and scope of the appended claims will become apparent to those skilled in this art. The invention is therefore only intended to be limited by the appended claims or their equivalents.

What is claimed is:

1. A thermal spray powder comprising granules of a metal each having an organo-zirconate bonded thereto.

2. A thermal spray powder according to claim 1 wherein the metal is an alloy of aluminum with silicon.

3. A thermal spray powder according to claim 1 wherein the organo-zirconate is in the form of discrete particles bonded to the granules of metal with an organic binder.

4. A thermal spray powder according to claim 1 wherein the organo-zirconate is a neoalkoxy zirconate.

5. A thermal spray powder according to claim 4 wherein the neoalkoxy zirconate is zirconium IV 2,2(bis-2-propenolatomethyl) butanolato, tris 2-propenoato-O.

6. A thermal spray powder formed by a process comprising forming a slurry of a metal powder and an organo-zirconate powder with an organic binder, and drying the slurry to form an organo-zirconate coated powder.

* * * * *

UNITED STATES PATENT AND TRADEMARK OFFICE

CERTIFICATE OF CORRECTION

PATENT NO. : 5,126,205

DATED : June 30, 1992

INVENTOR(S) : Tuck Chon et al.

It is certified that error appears in the above-identified patent and that said Letters Patent is hereby corrected as shown below:

Title page, item [75], change Inventors: "Retolico" to --Rotolico--

Signed and Sealed this

Thirty-first Day of August, 1993

Bruce Lehman

*Attest:*

BRUCE LEHMAN

*Attesting Officer*

*Commissioner of Patents and Trademarks*